United States Patent [19]

Asano

[11] 4,226,221

[45] Oct. 7, 1980

[54] CLOSED LOOP MIXTURE CONTROL SYSTEM FOR INTERNAL COMBUSTION ENGINE

[75] Inventor: Masaharu Asano, Yokosuka, Japan

[73] Assignee: Nissan Motor Company, Limited, Yokohama, Japan

[21] Appl. No.: 28,865

[22] Filed: Apr. 10, 1979

[30] Foreign Application Priority Data

Jun. 13, 1978 [JP] Japan ..... 53-70311

[51] Int. Cl.[2] ..... F02B 3/00; F02M 7/00

[52] U.S. Cl. ..... 123/440

[58] Field of Search ..... 123/119 EC, 32 EE; 60/276, 285

[56] References Cited

U.S. PATENT DOCUMENTS

| | | | |
|---|---|---|---|
| 4,112,893 | 9/1978 | Anzai | 123/119 EC |
| 4,120,269 | 10/1978 | Fujishiro | 123/32 EE |
| 4,131,089 | 12/1978 | Fujishiro | 123/32 EE |
| 4,153,023 | 5/1979 | Asano | 123/119 EC |
| 4,167,163 | 9/1979 | Moder | 123/119 EC |
| 4,167,925 | 9/1979 | Hosaka | 123/119 EC |

*Primary Examiner*—Ronald B. Cox

*Attorney, Agent, or Firm*—Lowe, King, Price & Becker

[57] ABSTRACT

A closed loop mixture control system for an internal combustion engine comprises an exhaust gas sensor, a source of injecting a current into the exhaust gas sensor to develop a substantial voltage across the internal impedance thereof, and a variable reference setting circuit which establishes a variable reference voltage and reduces its value as a function of time such that the reference voltage lies between the maximum and minimum peak values of the output signal from the exhaust gas sensor.

7 Claims, 14 Drawing Figures

CLOSED LOOP MIXTURE CONTROL SYSTEM FOR INTERNAL COMBUSTION ENGINE

FIELD OF THE INVENTION

The present invention relates to closed loop mixture control systems for internal combustion engines, and in particular to such a system capable of providing closed loop control mode under low temperature conditions to minimize noxious emissions when the engine is warmed up.

BACKGROUND OF THE INVENTION

The use of an exhaust gas sensor such as zirconia dioxide oxygen sensor as a means of deriving a feedback control signal for controlling the air-fuel mixture ratio at a desired point is well known for allowing a three-way catalytic converter to operate its maximum conversion efficiency, thus minimizing the amount of noxious waste products. Such oxygen gas sensor however exhibits a very high internal impedance when temperature in the exhaust system is very low during the warm-up period of the engine and thus the voltage derived from the gas sensor cannot be used to derive a valid feedback control signal. The usual practice is to detect the low temperature condition to suspend the closed loop operation until the gas sensor temperature reaches its normally operating level. Therefore, the noxious emissions are exhausted during such engine start periods.

SUMMARY OF THE INVENTION

The present invention contemplates to inject a current into the exhaust gas sensor to develop a voltage across its internal impedance. Because the internal impedance is very high at low temperatures, the voltage so developed is of a substantial magnitude which is advantageously free from the noise component which might contaminate the derived signal. The internal impedance of the gas sensor reduces as a function of temperature and hence with time until it reaches a steady state low value. According to the invention, the reference voltage with which the gas sensor output signal is compared to derive the feedback or deviation representative signal, is reduced as a function of time such that it lies within the maximum and minimum peak values of the gas sensor output. This extends the range of closed loop operation to low temperature regions, whereby the problem of emission during the engine start period is eliminated.

Therefore, an object of the invention is to extend the range of closed loop operation of fuel control to low temperatures to minimize the noxious waste products.

BRIEF DESCRIPTION OF THE DRAWINGS

The invention will be further described by way of example with reference to the accompanying drawings, in which.

DETAILED DESCRIPTION

Figure 1:
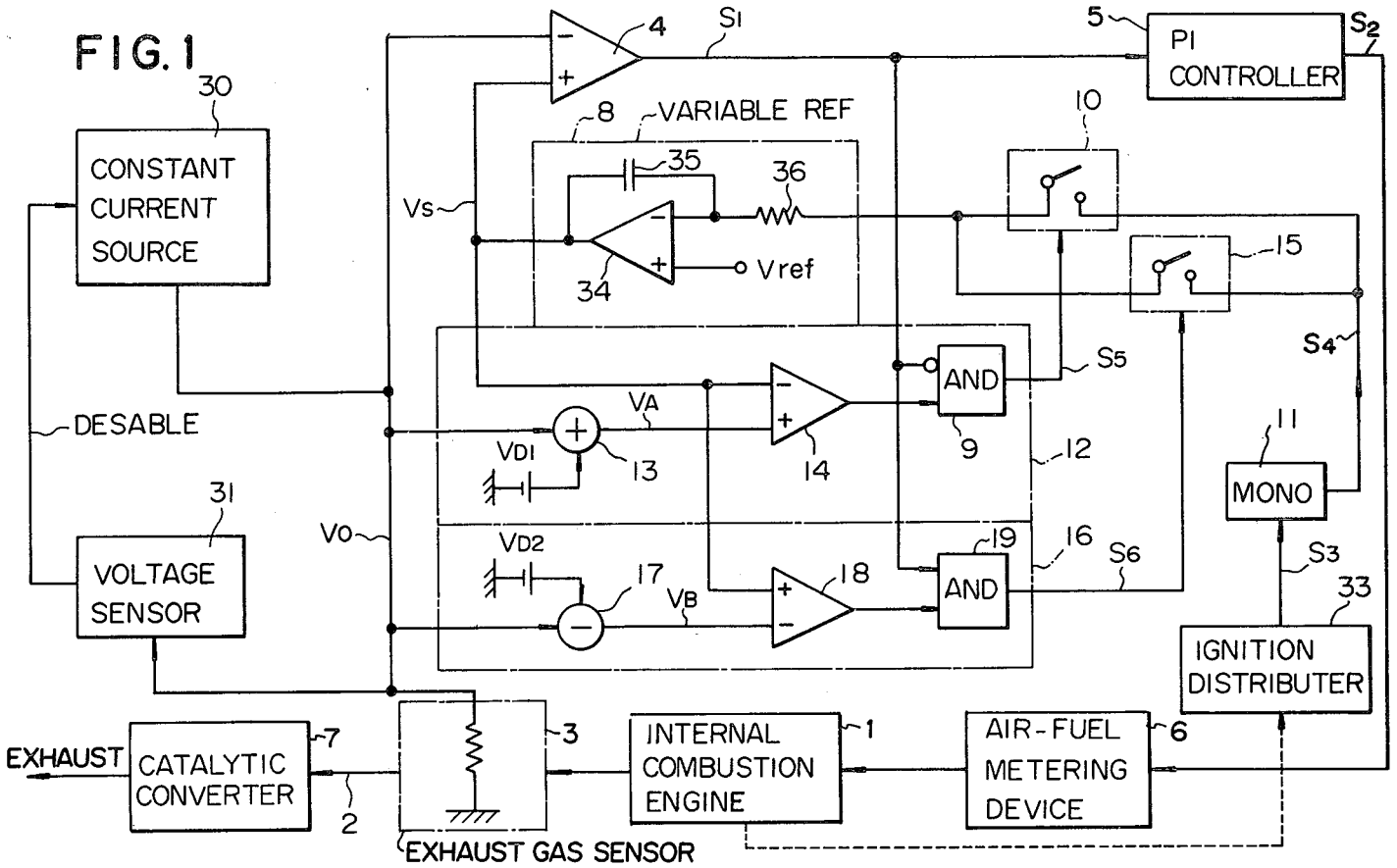
FIG. 1 is a circuit block diagram of an embodiment of the present invention.

In FIG. 1 the closed loop mixture control system according to the present invention includes an exhaust gas sensor 3 provided in the exhaust pipe 2 of an internal combustion engine 1. This exhaust gas sensor is a zirconia dioxide oxygen gas sensor commercially available which exhibits a considerably high internal impedance when temperature is very low, so that the voltage developed thereacross during cold start periods remains at considerably low voltage level. When the engine has warmed up the internal impedance of the gas sensor decreases to a normal value. The oxygen sensor 3 develops an output voltage having a high voltage level when the sensed concentration of the oxygen component of the emissions is smaller than a predetermined value and a low voltage level when the concentration is greater than the predetermined value. The predetermined value corresponds to the stoichiometric air-fuel ratio of the mixture supplied to the engine so that the high and low voltage levels of the exhaust gas sensor corresponds respectively to rich and lean mixtures with respect to the stoichiometric point.

A three-way catalytic converter 7 is provided which is capable of providing simultaneous oxidation of hydrocarbon and carbon monoxide and reduction of nitrogen oxides to thereby convert them into harmless waste products. The conversion efficiency of the catalytic converter is at a maximum when it is exposed to exhaust gases with the oxygen content corresponding to the predetermined value, i.e. when the air-fuel mixture ratio corresponds to the stoichiometric point.

The gas sensor output Vo is fed to the inverting input of a comparator 4 which receives as its noninverting input a reference voltage Vs from a variable reference setting circuit 8 to generate a deviation signal Vs which is at a high voltage level when the gas sensor output Vo is smaller than the reference voltage Vs. This reference voltage Vs is set at a point corresponding to the stoichiometric air-fuel ratio. Under normal closed loop operation, this reference voltage is 0.4 volts. When the gas sensor output is above or below this reference point, the comparator 4 provides a low or high voltage signal $S_1$ to a proportional-integral controller 5 which modifies the amplitude of the signal $S_1$ with a predetermined proportionality and a predetermined rate of integration and feeds its output to an air-fuel metering device 6 which may be an electronic carburetor or fuel injectors.

Figure 2:
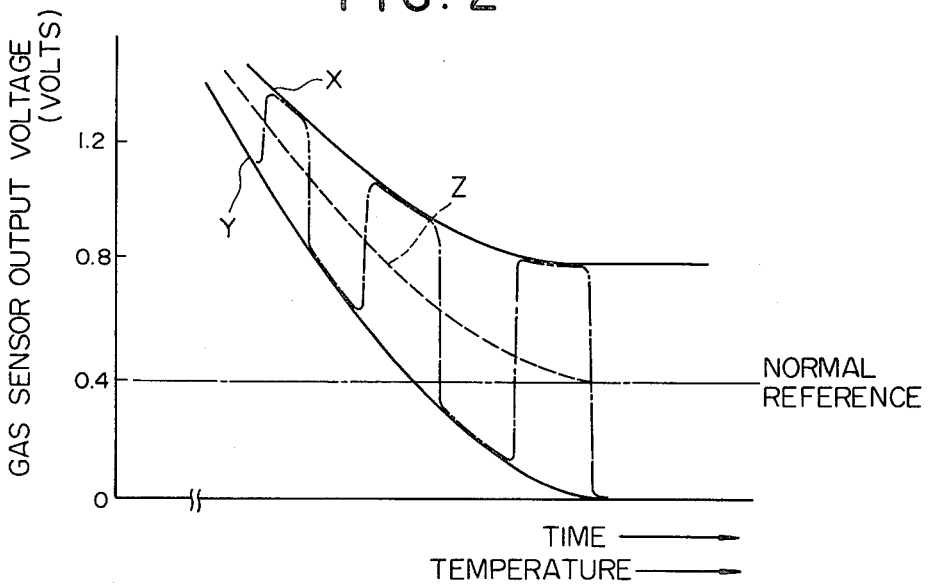
FIG. 2 is a graphic illustration of the output voltage of the exhaust gas sensor as a function of temperature and hence time.

In order to extend the operating range of the exhaust gas sensor 3 to low temperatures, a constant current source 30 is provided to inject current into the exhaust gas sensor 3 during low temperature condition of the gas sensor. When a current is injected into the exhaust gas sensor 3 the voltage developed across its internal impedance represents a DC voltage, which is a product of the injection current and the internal impedance, plus the gas sensor output voltage. Since the latter takes on the high and low voltage levels in response to rich and lean mixture conditions respectively and the internal impedance decreases with temperature and hence with time, the voltage derived from the exhaust gas sensor 3 adopts a curve X which is an envelope of the maximum peak values representing rich mixtures and a curve Y which is an envelope of the minimum peak values representing lean mixtures, as illustrated in FIG. 2.

To permit the injection current to flow only during the low temperature periods, a voltage sensor 31 is connected to the exhaust gas sensor 3 to detect when its output voltage has reduced to a level which occurs when the gas sensor temperature is above its normally operating temperature.

The operating range of the exhaust gas sensor 3, and hence the range of closed loop operation, can be extended if the reference voltage Vs is so varied that it adopts a curve Z which lies between curves X and Y.

This is accomplished by a variable reference setting circuit 8 which first sets up a certain initial reference level and then reduces it as a function of time. This variable reference circuit essentially comprises an operational amplifier 34, an integrating capacitor 35 and an integrating resistor 36, all of which are connected in a well-known integrator circuit configuration and arranged to receive a pulse signal from a monostable multivibrator 11 through a gate circuit 10 or 15 at the inverting input terminal of the operational amplifier 34, the noninverting input of the amplifier 34 being connected to a source of positive potential Vref. The monostable 11 is connected to receive ignition pulses from the ignition distributer 33 or any other source that provides pulses in synchronism with the engine crankshaft revolution.

Thus, in response to each engine crankshaft revolution a constant duration pulse is supplied from the monostable 11 to the inverting input of the operational amplifier integrator 34. The latter then provides integration of the input pulse in the negative direction so that the voltage Vref, which is the initial reference value, is reduced by an amount proportional to the time constant value of the capacitor 35 and resistor 36 in step with each engine revolution.

If the reference voltage Vs is allowed to continue to reduce in step with the engine revolution and if the exhaust gas sensor output Vo remains low for an extended period of time in the presence of a prolonged lean mixture condition, the variable reference value Vs would be lower than the minimum peak value of the gas sensor output as represented by curve Y. Under these circumstances closed loop operation is no longer possible.

According to the invention, a low level detecting circuit 12 is provided to detect when the gas sensor output voltage reaches a value slightly greater than the minimum peak value of the gas sensor output and generate a gate control signal $S_5$ to open the gate circuit 10 to allow the passage of the pulse signal from the monostable 11. As shown the detecting circuit 12 comprises an adder 13 which adds up a DC voltage $V_{D1}$ to the gas sensor output voltage Vo to deliver a sum voltage $V_A$ to the noninverting input of a comparator 14 to the inverting input of which is applied the reference voltage Vs. The output of the comparator 14 is switched to a high voltage level when the voltage $V_A$ is equal to or greater than the reference voltage Vs, the high voltage comparator output being applied to an input of an AND gate 9. Another input of the AND gate 9 is an inverted input terminal which receives the deviation signal $S_1$. Therefore, when the deviation signal $S_1$ is low indicating a lean mixture condition, the AND gate 9 goes into a high output state in response to the comparator 14 output to thereby deliver a gate control signal $S_5$ to open the gate 10 to apply pulses from the monostable 11 to the variable reference circuit 8.

A high level detecting circuit 16 is also provided to detect when the gas sensor output voltage reaches a value slightly smaller than the maximum peak value of the gas sensor output and generates a gate control signal $S_6$ to open the gate 15 to allow passage of the pulse signal from the monostable 11 to reduce the reference voltage Vs in step with the engine crankshaft revolution. This high level detector circuit comprises a substractor 17 which subtracts a DC voltage $V_{D2}$ from the gas sensor output voltage Vo to deliver a subtracted voltage $V_B$ to the inverting input of a comparator 18 whose noninverting input is connected to receive the reference voltage Vs. The comparator 18 goes into a high output state when the voltage $V_B$ is smaller than Vs, the comparator 18 output being passed through an AND gate 19 when the latter is enabled in response to the high voltage state of the deviation signal $S_1$ indicating a rich mixture condition. The output signal from the AND gate 19 is the gate control signal $S_6$ which therefore occurs when the gas sensor output reaches a value slightly smaller than the maximum peak of the gas sensor output Vo.

Figure 3:
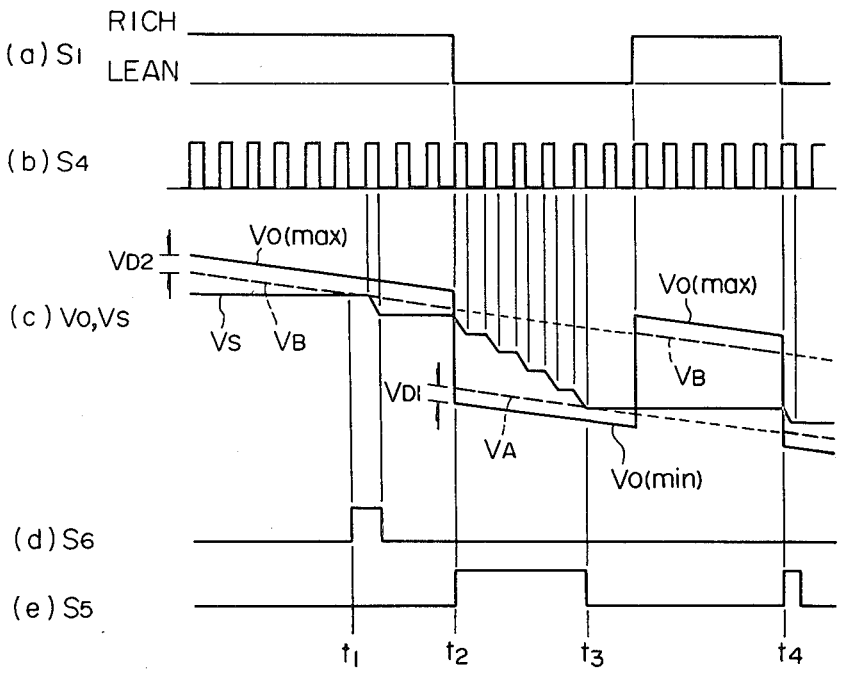
FIG. 3, parts *a–e*, is an illustration of various waveforms associated with the circuit of FIG. 1.

The operation of the circuit of FIG. 1 will best be described with reference to waveforms shown in FIGS. 3*a* to 3*e*. FIG. 3*a* is a waveform of the deviation signal $S_1$ which assumes a high voltage level when the mixture ratio is richer than stoichiometric point and a low voltage level when the mixture is leaned with respect to the stoichiometric point. FIG. 3*b* shows the pulse signal $S_4$ supplied from the monostable 11. FIG. 3*c* shows gas sensor output voltage having maximum and minimum peaks in solid line and voltages $V_A$ and $V_B$ in broken lines. During the warming period of the engine the constant current source 30 is enabled to inject current to the exhaust gas sensor 3. Because of the high internal impedance of the gas sensor, the maximum and minimum peaks of the gas sensor 3 are relatively high and the reference voltage Vs is set at a relatively high level which lies between the maximum and minimum peaks. As the gas sensor temperature goes high with the resultant decrease in the internal impedance, both maximum and minimum peaks of the gas sensor output decrease, so that at time $t_1$ the voltage $V_B$ becomes smaller than the reference Vs. Since the deviation signal $S_1$ is assumed to be at high voltage level signifying a rich mixture condition, the AND gate 19 provides a gate control signal $S_6$ to open the gate 15 to allow a pulse $S_{4\text{-}1}$ to be applied to the inverting input of the integrator 34 of the variable reference setting circuit 8 to reduce its reference voltage to a level lower than $V_B$. This reduction of the reference voltage terminates the output of the comparator 18 and hence the signal $S_6$, thus terminating the supply of pulses $S_4$ to the reference setting circuit 8. The reduced reference voltage is maintained until the mixture is switched to the lean side at time $t_2$. Since the voltage $V_A$ is much smaller than the reference voltage Vs at time $t_2$, the comparator 14 generates a high voltage level output, so that the AND gate 9 delivers a gate control signal $S_5$ to open the gate 10 to allow pulses $S_{4\text{-}2}$ to $S_{4\text{-}6}$ to be applied to the reference circuit 8 to permit the latter to reduce its reference voltage stepwisely until it reaches the voltage $V_A$. Comparator 14 senses this condition and switches off the gate control signal $S_5$ at time $t_3$. The reference voltage is thus maintained above the minimum peak level of the gas sensor output voltage. When the deviation signal $S_1$ switches to a high voltage level signifying rich mixtures, the AND gate 9 is disabled to maintain the reference voltage until at time $t_4$ whereupon the mixture is switched to the lean side to enable the AND gate 9 again to apply pulse $S_{4-7}$ to the reference circuit 8. Therefore, the variable reference voltage is maintained within the boundaries of the maximum and minimum peak values of the exhaust gas sensor 3.

The reduction of the reference voltage in synchronism with the engine crankshaft revolution provides an advantage in that since the concentration of oxygen component in the exhaust gases changes at a rate proportional to the engine speed the period during which the reference voltage is stepwisely reduced also changes as a function of the engine speed. Therefore, at lower engine speeds the rate of reduction is smaller than at higher engine speeds.

Figure 4:
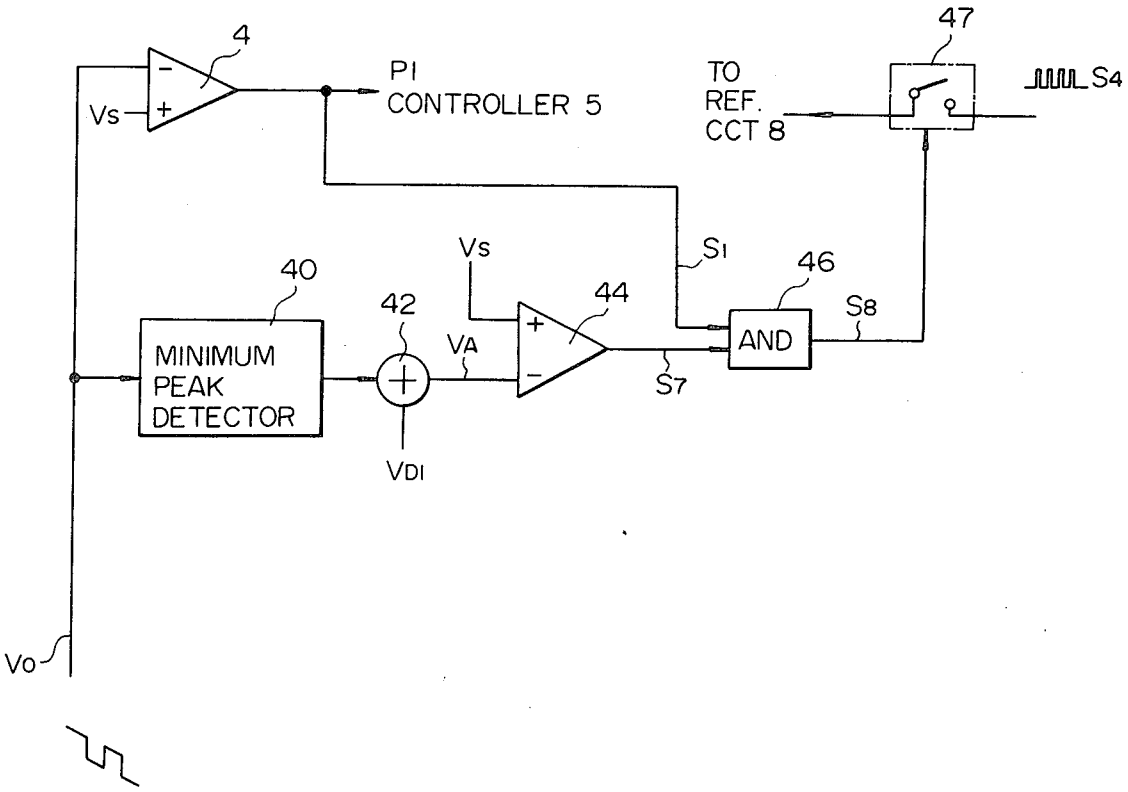
FIG. 4 is a circuit diagram of another embodiment of the invention.

FIG. 4 is a modification of the invention in which a minimum peak detector 40 is provided to detect the minimum peak value of the exhaust gas sensor output Vo and hold the detected value until the subsequent minimum peak. To the detected minimum peak is added the DC voltage $V_{D1}$ in an adder 42 to provide a sum voltage $V_A$ which is applied to the inverting input of a comparator 44 for comparison with the reference voltage Vs.

Comparator 44 switches to a high voltage output state when the sum voltage $V_A$ reduces below the reference voltage Vs, providing a signal $S_7$ to an AND gate 46 to which is also applied the deviation signal $S_1$.

Figure 5:
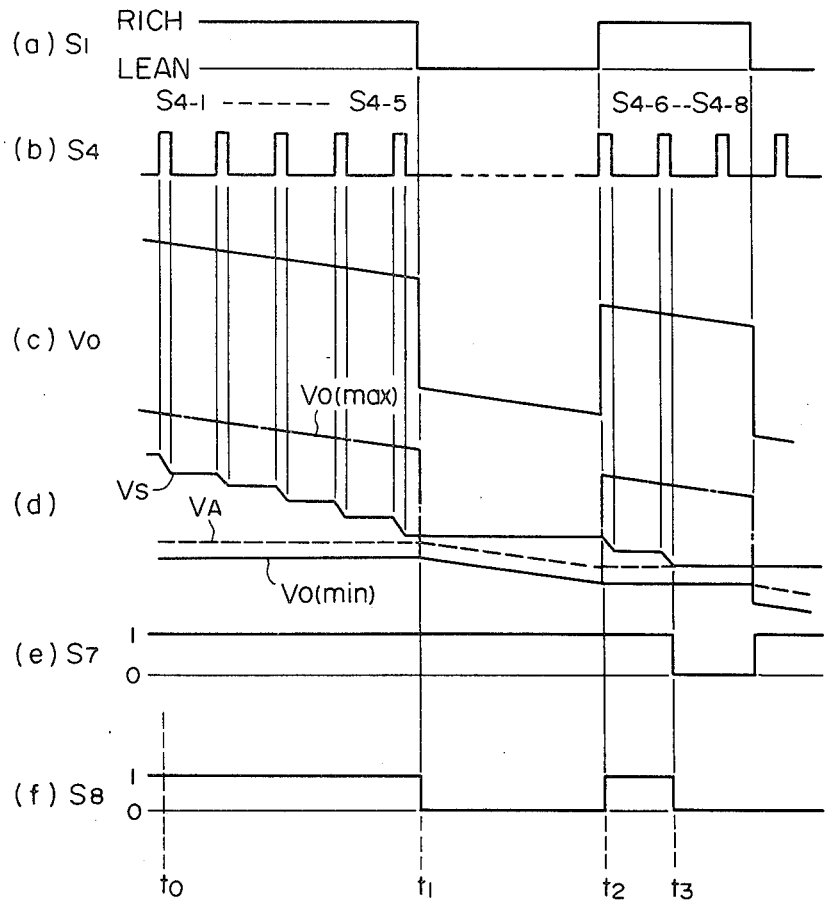
FIG. 5, parts *a–f*, is an illustration of waveforms associated with the circuit of FIG. 4.

The operation of the circuit of FIG. 4 is best described with reference to FIG. 5. As shown in FIG. 5*d*, during the time period $t_o$ to $t_l$ the deviation signal is high signifying a rich condition and the comparator 44 generates a high level output signal $S_7$. Consequently, the AND gate 46 provides a high level signal $S_9$ to establish a passage in a gate 47 for the reduction pulse $S_4$ to the reference circuit 8. Therefore, under rich mixture condition, the reference voltage is progressively reduced in response to pulses $S_{4-1}$ to $S_{4-5}$ until it reduces to the voltage level $V_A$ at time $t_1$ whereupon the comparator 44 output goes into a low voltage state to terminate the supply of the reduction pulses $S_4$. The reference voltage Vs is maintained at a point near $V_A$ and remains there until at time $t_2$ when the mixture condition switches to enrichment. At time $t_2$ the AND gate 47 provides a high level signal $S_9$ to apply reduction pulses $S_{4-6}$ and $S_{4-7}$ to the reference circuit 8, so that the reference voltage is reduced during period $t_2$ to $t_3$ to a level near $V_A$. Therefore, with the circuit of FIG. 4, the variable reference voltage is stepwisely reduced during the rich mixture condition to a level above the minimum peak value of gas sensor output and maintained there during the lean condition until the subsequent rich condition.

What is claimed is:

1. A closed loop mixture control system for an internal combustion engine having an exhaust gas sensor for generating a signal representing the concentration of a predetermined constituent of the emissions of the engine, said exhaust gas sensor having an internal impedance which varies inversely as a function of temperature, and means for generating a signal representing the deviation of said concentration representative signal from a reference voltage to correct the air-fuel ratio of the mixture supplied to said engine, said deviation representative signal having a first voltage level corresponding to a lean mixture condition and a second voltage level corresponding to a rich mixture condition, comprising:

means for injecting a current into said exhaust gas sensor to raise the voltage level of said concentration representative signal, whereby said voltage level decreases from a high to a low level as a function of temperature; and means for controlling said reference voltage to lie between the maximum and minimum peak values of said concentration representative signal.

2. A closed loop mixture control system as claimed in claim 1, wherein said controlling means comprises means for establishing said reference voltage at a given initial value, means for causing said reference voltage to reduce from said initial value as a function of time in response to said deviation representative signal having said first voltage level until said reference voltage reaches a point near the minimum peak value of said concentration representative signal, and means for detecting when said reference voltage reaches a point near the maximum peak value of said concentration representative signal to reduce said reference voltage.

3. A closed loop mixture control system as claimed in claim 1, wherein said controlling means comprises means for establishing said reference voltage at a given initial value, means for reducing said reference voltage from said initial value as a function of time in response to said deviation signal having said second voltage level until said reference voltage reaches a point near the minimum peak value of said concentration representative signal.

4. A closed loop mixture control system as claimed in claim 2 or 3, wherein said reference voltage is reduced stepwisely.

5. A closed loop mixture control system as claimed in claim 4, wherein said reference voltage is reduced in step with each revolution of the engine crankshaft.

6. A closed loop mixture control system as claimed in claim 2 or 3, wherein said reference establishing means comprises an integration circuit including an operational amplifier having an inverting and a noninverting input terminal and an output terminal, a capacitor connected between said inverting input terminal and said output terminal and a resistor connected at one end to said inverting input terminal and at the other end to a source of periodic pulses, said noninverting input being biased at a potential corresponding to said given initial value.

7. A closed loop mixture control system as claimed in claim 6, wherein said periodic pulses are synchronized with the revolution of the engine crankshaft.

* * * * *